US005297711A

United States Patent [19]

Kogan

[11] Patent Number: 5,297,711

[45] Date of Patent: Mar. 29, 1994

[54] PERFORATED WEB TRANSPORT SYSTEM

[75] Inventor: Eduard Kogan, Queens, N.Y.

[73] Assignee: Miltope Corporation, Melville, N.Y.

[21] Appl. No.: 66,998

[22] Filed: May 24, 1993

[51] Int. Cl.[5] ..... B27B 3/02

[52] U.S. Cl. ..... 225/98; 225/100

[58] Field of Search ..... 225/2, 4, 5, 98, 100, 225/101

[56] References Cited

U.S. PATENT DOCUMENTS

| | | | |
|---|---|---|---|
| 2,171,769 | 9/1939 | Stolar et al. | 225/100 |
| 2,925,946 | 2/1960 | Graver | 83/176 |
| 4,136,604 | 1/1979 | Schmidt | 225/101 |

FOREIGN PATENT DOCUMENTS

| | | | |
|---|---|---|---|
| 509153 | 10/1992 | European Pat. Off. | 225/2 |

*Primary Examiner*—Hien H. Phan

*Attorney, Agent, or Firm*—Whitham & Marhoefer

[57] ABSTRACT

A perforated web transporting and separating system in which two longitudinally spaced drive mechanisms move the web, an upstream drive and a downstream drive. A platen supports and guides the web; the platen has two sections, and one section can be slightly rotated in the plane of the web with respect to the other section. In separating the web along a row of perforations, the web is driven to a point where the row of perforations is between the platen sections. The upstream drive is stopped while the downstream drive continues to attempt to drive the web, creating a tension in the web across the row of perforations. With the web in tension, one section of the guide platen is articulated relative to the other, tearing the web along the tensioned row of perforations.

8 Claims, 3 Drawing Sheets

PERFORATED WEB TRANSPORT SYSTEM

DESCRIPTION

Background of the Invention

1. Field of the Invention

This invention relates to a transport system for perforated webs, and more particularly to an improved system to separate segments of the web along the perforations as the web is being transported.

2. Description of the Prior Art

As will be appreciated by those skilled in the art, there are a number of applications that use a continuous web that has rows of perforations located periodically along its length so that the web can be separated into discrete sheets or cards after processing. One application to which the teachings of this invention are particularly well suited, is a printer for printing on a perforated card stock. Here the perforated card stock is transported to the printing mechanism as a continuous web with a row of perforations where the printed card stock is to be separated.

There are several prior art schemes for automatically separating the web along its perforation. Typical prior art schemes use a blade to cut and/or burst the web along the row of perforations. Each prior art schemes are not altogether satisfactory. They are relatively inefficient, noisy, and generate dust particles.

SUMMARY OF THE INVENTION

An object of this invention is the provision of an efficient, quiet, relatively dust-free system to transport and separate a perforated web.

Briefly, this invention contemplates the provision of a perforated web transporting and separating system in which two longitudinally spaced drive and pinch roller pairs move the web; an upstream pair and a downstream pair. A platen supports and guides the web; the platen has two sections, and one section can be slightly rotated in the plane of the web with respect to the other section. In separating the web along a row of perforations, the web is driven to a point where the row of perforations between the platen sections. The upstream drive roller is stopped while the downstream drive roller continues to attempt to drive the web, creating a tension in the web across the row of perforations. With the web in tension, one section of the guide platen is articulated relative to the other, tearing the web along the tensioned row of perforations.

After the web has been parted along the row of perforations, the sections of the platen are realigned, and the downstream drive roller drives the separated section of the web along the transport path. The upstream drive roller is energized and it drives the web until it is engaged by the downstream drive and pinch roller and the next row of perforations is adjacent the gap. At this point the upstream drive and pinch roller pair is again stopped, and the above-described operation is repeated.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
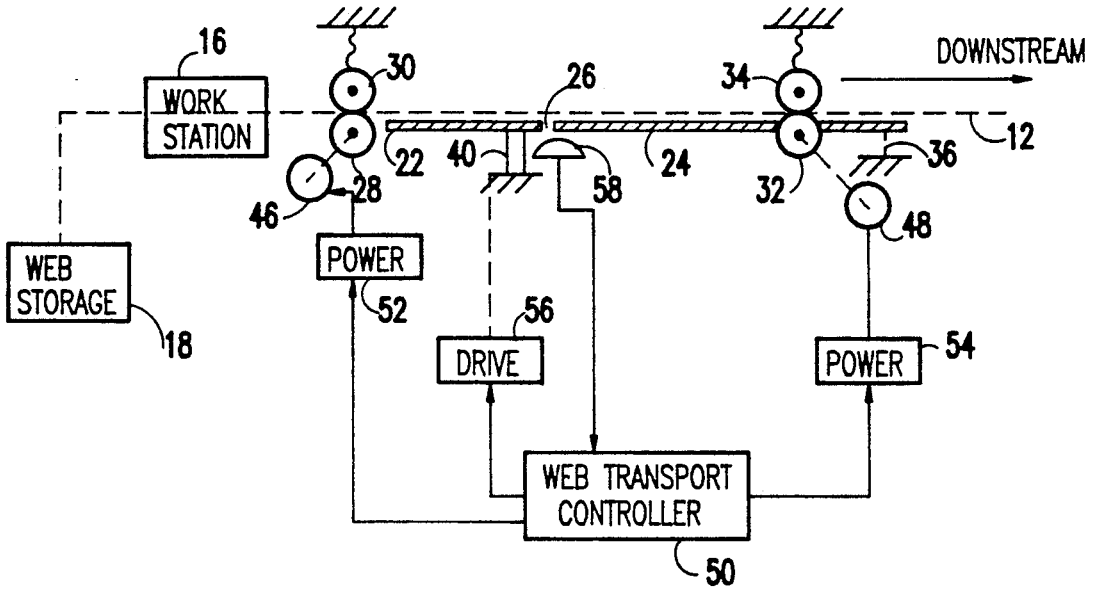
FIG. 1 is a schematic block diagram of a perforated web transport and separation system in accordance with the teachings of this invention.
Figure 2:
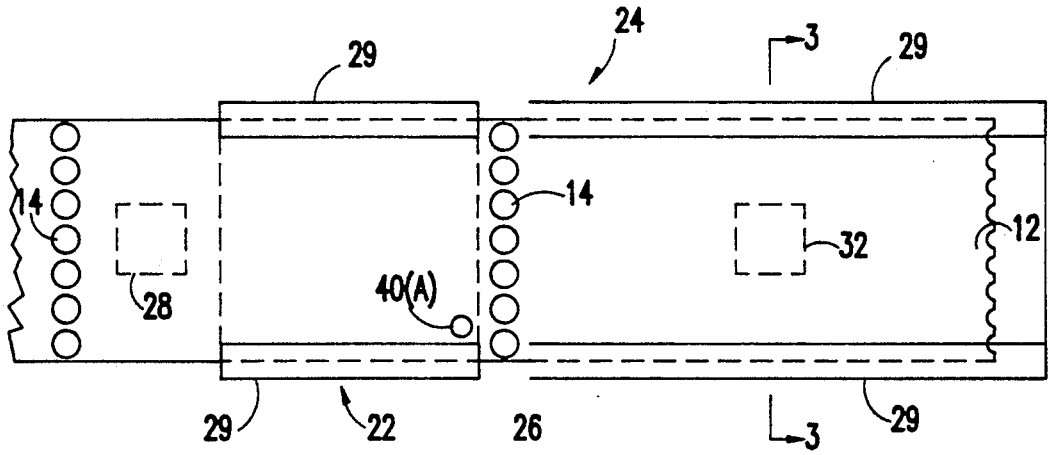
FIG. 2 is a fragmentary plan view of platens indicated schematically in FIG. 1.
Figure 3:
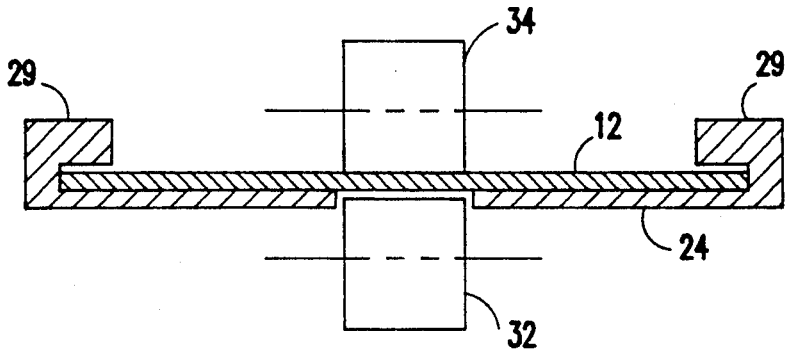
FIG. 3 is a sectional view along the line 3—3 of FIG. 2.

Referring now to FIGS. 1, 2, and 3, a web 12 (shown as a dashed line in FIG. 1) has a row 14 of perforations located at periodically-spaced locations along the length of the web. The web 12 is fed, for example, from a web storage receptacle 18.

The web 12 is supported and guided by an upstream platen section 22 and a downstream platen section 24; where the two sections meet they form a region or line 26 along which the web is parted. Here the region 26 is shown as a small gap between the platen sections although it will be appreciated that one platen section could partially underlie the other, for example, so that, while relatively movable, there would be no gap between the platen sections at their base. A "U"-shaped rail 29 on each side of each platen section guides the web 12. Here it should be noted that there is a break between the "U"-shaped guide rail section on either side of the region 26 in order to allow relative movement between sections. There is a drive mechanism (here drive roller 28 and pinch roller 30 on the upstream side of the side of the region 26 and a drive mechanism drive roller 32 and pinch roller 34) on the downstream side of the region 26. Here it should be noted that any suitable web drive mechanism may be used and that the drive and pinch roller combination is only exemplary. For example, the downstream pinch roller 34 could be replaced by a print head in a printer application of the invention. The upstream drive roller 28 and pinch roller 30 and platen section 22 are preferably secured to a common frame section (indicated schematically at 31) and the frame section is movable relative to the downstream frame section, on the downstream side the pinch roller engages the web 12 through an opening in the bottom of the platen section 24. The downstream platen section is preferably rigidly supported by a transport frame, as indicated schematically at 36 in FIG. 1. The frame section 31 that carries upstream platen section 22 is pivotally mounted (indicated schematically by rod 40) with respect to the downstream platen section 24. A suitable platen drive 42, such as a motor or solenoid, is connected to the upstream platen to cause the upstream platen section 22 to rotate in the plane of the web with respect to the downstream platen through a small arc.

A motor 46 is connected to the upstream drive roller 28 and a motor 48 is connected to the downstream drive roller 32. A controller 50, such as microprocessor-based controller, for example, controls the operation of motors 46, 48, and platen pivot 40 via power supplies 52, 54 and driver 56, respectively. A sensor may be used to determine when a row of perforations is adjacent the gap. Alternatively, a stepper motor 46 may be used to advance the web a predicting distance equal to the distance between rows 14 of perforations. A suitable sensor 58 (e.g., either an optical or mechanical sensor) located in this exemplary embodiment below the region 26, can be used to determine when the web 14 has been parted successfully and the downstream section has left the region 26.

In operation, the upstream drive and pinch roller combination 28–30 initially feed the web 12 into the upstream platen and guide 22 while it is aligned with downstream platen and guide 24. The web 12 advances in a downstream direction and its leading edge enters the nip between the downstream drive and pinch roller combination 32–34. The upstream and downstream drive rollers at this point are both driving the web in a downstream direction. When the web advances to a point where a row 14 of perforations is adjacent the gap 26, the sensor 58 generates an output signal to controller 50. In response, the controller generates an output to power supply 52 to cause motor 46 to stop drive roller 28 and maintain it in a stopped position against the frictional force exerted by the web 12, which continues to be driven by drive roller 32. The friction forces exerted by the upstream and downstream drive and pinch roller combinations are adjusted so that web motion stops, or alternatively, slows the web to speed where the upstream platen 22 can be rotated to part the web while the row 14 of perforations is adjacent the gap 26. It will be appreciated the retarding force exerted by the stopped upstream drive and pinch rollers in combination with the continued driving force of the downstream drive and pinch rollers creates a tension across the row 14 of perforations adjacent the gap 26; a tension that is less than that needed to part the web.

Figure 4:
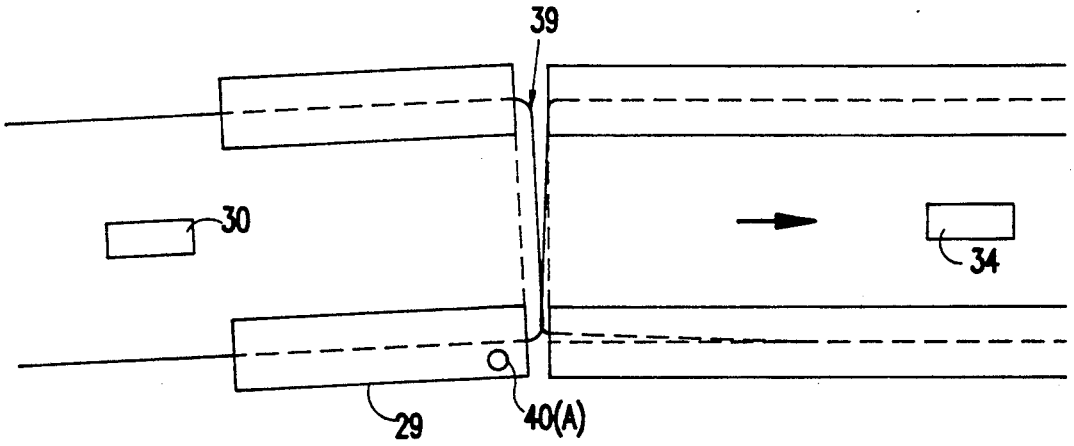
FIG. 4 is a figure similar to FIG. 2 illustrating the tearing action in accordance with the teachings of this invention.

Referring now to FIG. 4, with the web in tension and the row of perforations adjacent the gap 12, the controller 50 and drive 56 rotate the upstream platen section 22 in the plane of the web about a suitable point, preferably a point close to one downstream corner of the platen (i.e., point A in FIG. 2). This accurate movement of the upstream platen relative to the downstream platen (on the order of 0.1 inch as, for example, at the corner of the platen opposite the pivot point) generates an increased tension, starting at an edge 39 of the web 12. This causes the web to tear along the row of perforations, starting at the edge 39 and progressing along the row until the web is parted completely along the row of perforations.

The downstream drive and pinch roller 32–34 transport the now parted piece of the web clear of the gap 26 and along a path, where it is deposited or otherwise processed as desired. The controller 50 commands the platen drive 56 to restore the upstream platen 22 to a position aligned with downstream platen. When the platens are aligned, the controller 50 restarts the upstream drive roller 46, and drive and pinch roller 28–30 transport the web 12 so that leading edge created by the portion of the web enters the nip between the downstream drive and pinch rollers 32–34, and above-described process is repeated.

Figure 5:
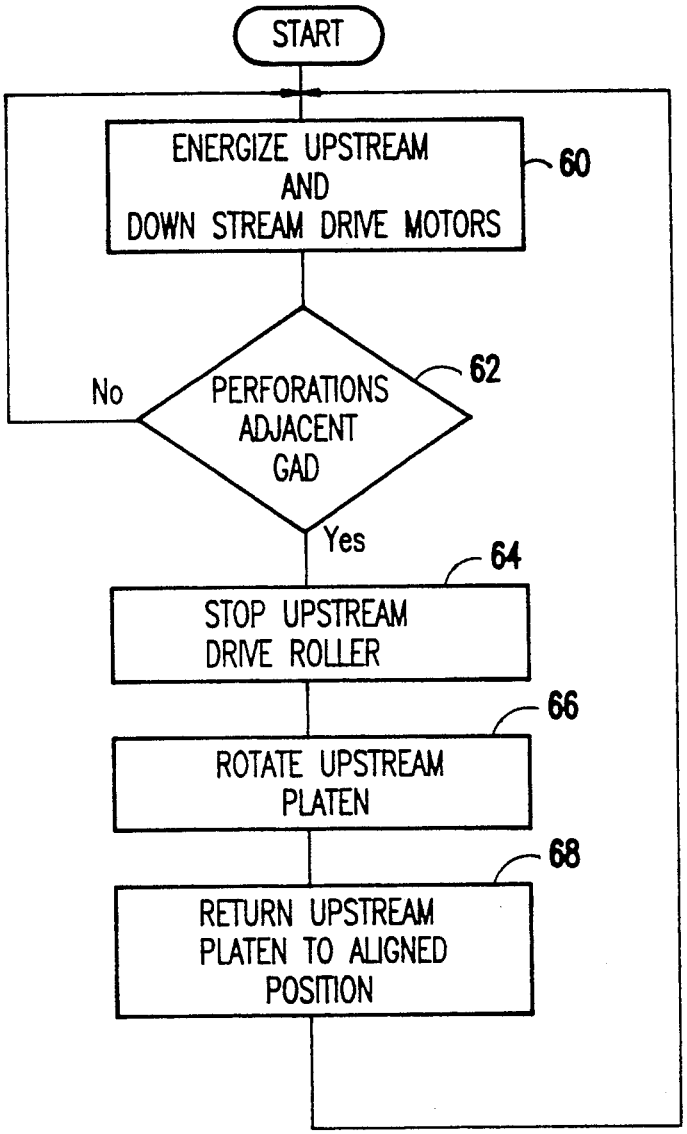
FIG. 5 is a flow diagram of the steps in transporting and separating a perforated web in accordance with the teachings of this invention.

Referring now to FIG. 5, the process starts with the controller 50 causing both the upstream and downstream drive rollers to be energized so as to drive the web in a downstream direction, block 60. This operating mode continues until it is determined that a row 14 of perforations is adjacent the gap, decision block 62. When a row of perforations is adjacent the gap, the controller stops the upstream drive roller, block 64. Next, the controller rotates the upstream platen through an arc, block 66, parting the web along the row of perforations. Next, the upstream platen is returned to a position aligned with the downstream platen, block 68, the upstream drive roller is again energized to drive the web in a downstream direction as the process repeats itself.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A system for transporting a perforated web and for separating the web along a row of perforations that extend in a direction orthagonal to the direction in which the web is transported, comprising in combination:

a upstream platen for guiding said web and a downstream platen for guiding said web, said upstream and downstream platens meeting along a web parting line;

means to tension said web across said web parting line; and means to rotate said upstream platen relatively to said downstream platen about an axis substantially perpendicular to the surface of the web in order to part said web along a row of perforations by combined stresses generated by said means to tension said web and said means to rotate said upstream platen relatively to said downstream platen.

2. A system for transporting a perforated web and for separating the web along a row of perforations as in claim 1, wherein said means to tension said web across said web parting line includes upstream drive means that are maintained in a stop position and downstream drive means that continue to attempt to drive said web.

3. A system for transporting a perforated web and for separating the web along a row of perforations as in claim 2, wherein said upstream drive means comprises a drive roller and a pinch roller.

4. A system for transporting a perforated web and for separating the web along a row of perforations as in claim 2, wherein said upstream platen and said downstream platen include a U-shaped rail for guiding said web.

5. A system for transporting a perforated web and for separating the web along a row of perforations as in claim 2, wherein said upstream drive means comprises a drive roller and a pinch roller.

6. A system for transporting a perforated web and for separating the web along a row of perforations as in claim 2, wherein said means to rotate said upstream platen includes means to pivotally support said upstream platen at a point adjacent said web parting line and adjacent one edge of said upstream platen.

7. A system for transporting a perforated web and for separating the web along a row of perforations as in claim 1, wherein said upstream platen and said downstream platen include a U-shaped rail for guiding said web.

8. A system for transporting a perforated web and for separating the web along a row of perforations as in claim 1, wherein said means to rotate said upstream platen includes means to pivotally support said upstream platen at a point adjacent said web parting line and adjacent one edge of said upstream platen.

* * * * *